US011541525B2

(12) United States Patent
Bothmann et al.

(10) Patent No.: US 11,541,525 B2
(45) Date of Patent: Jan. 3, 2023

(54) REVERSING MECHANISM FOR A POWER TOOL

(71) Applicant: Snap-on Incorporated, Kenosha, WI (US)

(72) Inventors: Richard Bothmann, Round Lake, IL (US); Brian King, Oak Creek, WI (US); Ray Kinsley, Mount Pleasant, WI (US)

(73) Assignee: Snap-on Incorporated, Kenosha, WI (US)

( * ) Notice: Subject to any disclaimer, the term of this patent is extended or adjusted under 35 U.S.C. 154(b) by 252 days.

(21) Appl. No.: 16/908,105

(22) Filed: Jun. 22, 2020

(65) Prior Publication Data

US 2021/0394351 A1 Dec. 23, 2021

(51) Int. Cl.

| | |
|---|---|
| ***F01C 13/02*** | (2006.01) |
| ***F01C 20/04*** | (2006.01) |
| ***F01C 21/08*** | (2006.01) |
| ***B25F 5/00*** | (2006.01) |

(52) U.S. Cl.

CPC ..... *B25F 5/001* (2013.01); *B25F 5/005* (2013.01); *F01C 13/02* (2013.01); *F01C 20/04* (2013.01); *F01C 21/08* (2013.01)

(58) Field of Classification Search

CPC ..... B25F 5/001; B25F 5/005; F01C 13/02; F01C 20/04; F01C 21/08

USPC ..... 173/169

See application file for complete search history.

(56) References Cited

U.S. PATENT DOCUMENTS

| | | | | |
|---|---|---|---|---|
| 2,109,239 | A | 2/1938 | Scholl | |
| 4,708,210 | A | 11/1987 | Rahm | |
| 5,199,460 | A | 4/1993 | Geiger | |
| 5,293,747 | A | 3/1994 | Geiger et al. | |
| 5,346,024 | A | 9/1994 | Geiger et al. | |
| 5,918,686 | A | 7/1999 | Izumisawa | |
| 6,044,917 | A | 4/2000 | Brunhoelzl | |
| 6,062,323 | A | 5/2000 | Pusateri et al. | |
| 6,656,626 | B1 | 12/2003 | Mooty et al. | |
| 6,935,437 | B2 * | 8/2005 | Izumisawa | B25F 5/00 173/221 |
| 7,222,680 | B2 | 5/2007 | Livingston et al. | |

(Continued)

FOREIGN PATENT DOCUMENTS

| | | | |
|---|---|---|---|
| AU | 2015230826 | C1 | 6/2017 |
| CN | 102729219 | A | 10/2012 |

(Continued)

OTHER PUBLICATIONS

Canadian Office Action for corresponding Application No. 3091382 dated May 27, 2022, 5 pages.

(Continued)

*Primary Examiner* — Deming Wan

(74) *Attorney, Agent, or Firm* — Seyfarth Shaw LLP

(57) ABSTRACT

A reversing mechanism for a pneumatically or hydraulically powered tool having a rotor adapted to selectively rotate in either one of first and second rotational directions. The reversing mechanism allows a user to actuate a button that rotates a valve to direct air flow through the tool. By pressing the button, the button will move a base laterally, and in doing so, rotates the valve. Rotating the valve distributes fluid to cause the rotor to rotate in a selected rotational direction.

31 Claims, 7 Drawing Sheets

(56) References Cited

U.S. PATENT DOCUMENTS

| | | | | |
|---|---|---|---|---|
| 7,594,549 | B2 | 9/2009 | Hua | |
| 7,886,840 | B2 | 2/2011 | Jane et al. | |
| 8,020,631 | B2 * | 9/2011 | Kobayashi | B25F 5/00 173/218 |
| 8,122,907 | B2 | 2/2012 | Murphy et al. | |
| 8,267,190 | B2 | 9/2012 | Li | |
| 8,347,979 | B2 | 1/2013 | Young et al. | |
| 8,739,832 | B2 | 6/2014 | Murphy et al. | |
| 9,254,561 | B2 | 2/2016 | Hua | |
| 9,322,417 | B2 | 4/2016 | Lai et al. | |
| 9,957,798 | B2 | 5/2018 | Su et al. | |
| 10,421,174 | B2 | 9/2019 | Wu et al. | |
| 10,626,725 | B2 | 4/2020 | Wen et al. | |
| 2003/0075348 | A1 | 4/2003 | Eardley et al. | |
| 2008/0066941 | A1 | 3/2008 | Kobayashi | |
| 2008/0251269 | A1 * | 10/2008 | Hua | B25B 21/00 173/104 |
| 2009/0272556 | A1 | 11/2009 | Jane et al. | |
| 2011/0139474 | A1 | 6/2011 | Jane et al. | |
| 2011/0186315 | A1 | 8/2011 | Li | |
| 2012/0073847 | A1 | 3/2012 | Nagasaka et al. | |
| 2012/0318544 | A1 | 12/2012 | Sun et al. | |
| 2012/0325510 | A1 | 12/2012 | Cheng et al. | |
| 2012/0325511 | A1 | 12/2012 | Cheng | |
| 2013/0156622 | A1 | 6/2013 | Lee | |
| 2014/0020923 | A1 | 1/2014 | Su | |
| 2014/0290973 | A1 | 10/2014 | Lin | |
| 2014/0295257 | A1 | 10/2014 | Harada | |
| 2015/0214520 | A1 | 7/2015 | Nishikawa et al. | |
| 2016/0258291 | A1 * | 9/2016 | Griffin | F01C 1/3441 |
| 2019/0160644 | A1 | 5/2019 | Wen et al. | |

FOREIGN PATENT DOCUMENTS

| | | | |
|---|---|---|---|
| CN | 203688958 | | 7/2014 |
| CN | 203882069 | | 10/2014 |
| CN | 204277893 | U | 4/2015 |
| CN | 205237926 | U | 5/2016 |
| EP | 844052 | | 1/2002 |
| FR | 2957286 | A1 | 9/2011 |
| JP | 4295228 | | 7/2009 |
| TW | I319346 | | 1/2010 |
| TW | I332890 | | 11/2010 |
| TW | M427219 | | 4/2012 |
| TW | 201236825 | | 9/2012 |
| TW | I396607 | | 5/2013 |
| TW | I402143 | | 7/2013 |
| TW | 201607698 | | 3/2016 |
| TW | M518145 | | 3/2016 |
| TW | 201720589 | | 6/2017 |
| TW | I604929 | | 11/2017 |
| TW | M569274 | | 11/2018 |
| TW | M569806 | | 11/2018 |
| TW | M574524 | | 2/2019 |
| TW | I656951 | | 4/2019 |
| TW | 202006274 | | 2/2020 |
| WO | 2018068325 | | 4/2018 |

OTHER PUBLICATIONS

Examination Report No. 1 for corresponding Application No. 2021203391 dated Mar. 11, 2022, 5 pages.

Taiwan Office Action for corresponding Application No. 11120349170 dated Apr. 13, 2022, 4 pages.

Combined Search and Examination Report for corresponding Application No. GB2107543.7 dated Apr. 20, 2022, 11 pages.

Examination Report for corresponding Application No. GB2107543.7 dated Oct. 11, 2022, 5 pages.

* cited by examiner

REVERSING MECHANISM FOR A POWER TOOL

TECHNICAL FIELD OF THE INVENTION

The present invention relates to a reversing mechanism that selectively changes the rotational direction of a hand operated power tool.

BACKGROUND OF THE INVENTION

Many tools are powered by pneumatic air or hydraulic fluid. Impact wrenches, for example, can impart torque to a work piece to loosen or tighten the work piece. At times, the rotational direction of the tool must be reversed, for example, when the work piece is left-hand threaded or when a user desires to loosen a right-hand threaded work piece instead of tighten it with the power tool.

Existing power tools include reversing mechanisms that selectively control the rotational direction of the tool. The reversing mechanism controls are typically located on the rear of the tool and can be a rotational knob and/or lever that the user can use to select the desired rotational direction of the tool. In other conventional tools, the reversing mechanism includes a longitudinal spool valve that slides to change the rotational direction of the tool by directing air or fluid in either of the clockwise or counterclockwise directions. These reversing mechanism controls are also typically located on the rear of the tool. Such a location requires the user to disengage the tool from a work piece to change the rotational direction of the tool.

Additionally, pneumatic and hydraulic tools receive air or fluid that includes contaminates that can corrode the components of the tools and/or cause locking of the components. One method to handle less than ideal air or fluid is to use a reversing mechanism that includes a rotary face seal valve. Rotary face seal valves do not typically require tight tolerances, thereby allowing small debris to pass through without causing locking issues. However, controls for reversing mechanisms that include rotary face seal valves are typically located on the rear of the tool.

SUMMARY OF THE INVENTION

The present invention relates broadly to a reversing mechanism for a power tool, such as a pneumatic or hydraulically powered tool, such as, for example, an impact wrench. The control for the reversing mechanism can be a side-to-side lever or switch disposed proximate to where a user operates the tool, such as a trigger that causes air or fluid to cause the rotation of the tool in either of first and second rotational directions. This location allows the control to be actuated by the user's index finger and thumb of the hand holding the tool. The reversing mechanism can also include a rotary face seal valve controlled by the side-to-side lever or switch. Accordingly, in an embodiment, the present invention broadly includes a reversing mechanism that incorporates a rotary face seal valve and is controlled by a side-to-side lever or switch disposed proximate to a trigger that operates the tool.

In particular, the present invention broadly comprises a tool powered by a fluid, such as hydraulic fluid or air. The tool includes a motor having a rotor that rotates in either of first and second rotational directions. The tool includes first and second buttons respectively disposed on opposing first and second sides of the tool, a base operatively coupled to the first and second buttons, a valve adapted to selectively direct fluid or air to cause the rotor to rotate in either of the first and second rotational directions, and a link arm rotatably coupled to the base and the valve, and slidably and rotatably coupled to a plate disposed in the tool. Movement of the base causes the link arm to rotate the valve about the valve axis.

In another embodiment, the present invention broadly comprises a reversing mechanism for a tool powered by fluid or air and having a rotor operable to drive an output lug in either of first and second rotational directions. The mechanism includes a base coupled to first and second buttons, a valve adapted to selectively direct fluid or air to cause the rotor to drive the output lug in either of the first and second rotational directions, and a link arm rotatably coupled to the base and the valve, and slidably and rotatably coupled to a plate disposed in the tool. Movement of the base causes the link arm to rotate the valve about the valve axis.

In yet another embodiment, the present invention broadly comprises a valve rotatable about a valve axis to selectively direct fluid to cause a rotor of a tool to drive an output lug of the tool in either one of the first and second rotational directions. The valve includes a valve inlet, a valve outlet, a projection adapted to abut a housing of the tool, and a channel disposed between the projection and the valve outlet and adapted to direct fluid away from the rotor. The valve is rotatable by actuation of first and second buttons of a reversing mechanism, the first and second buttons respectively disposed on first and second sides of the tool.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE INVENTION

Figure 1:
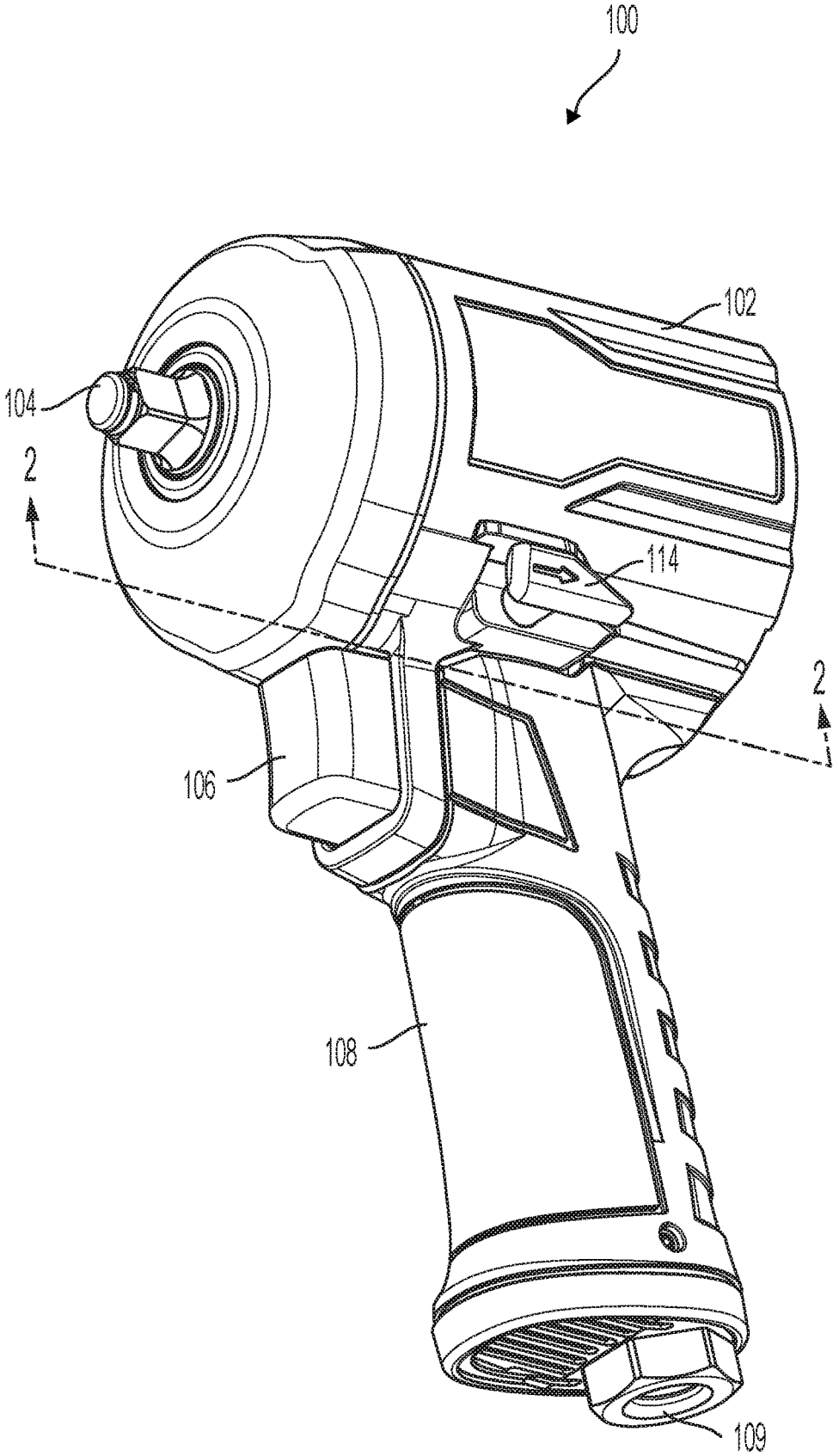
FIG. 1 is a front perspective view of an exemplar tool incorporating a reversing mechanism according to an embodiment of the present invention.
Figure 2:
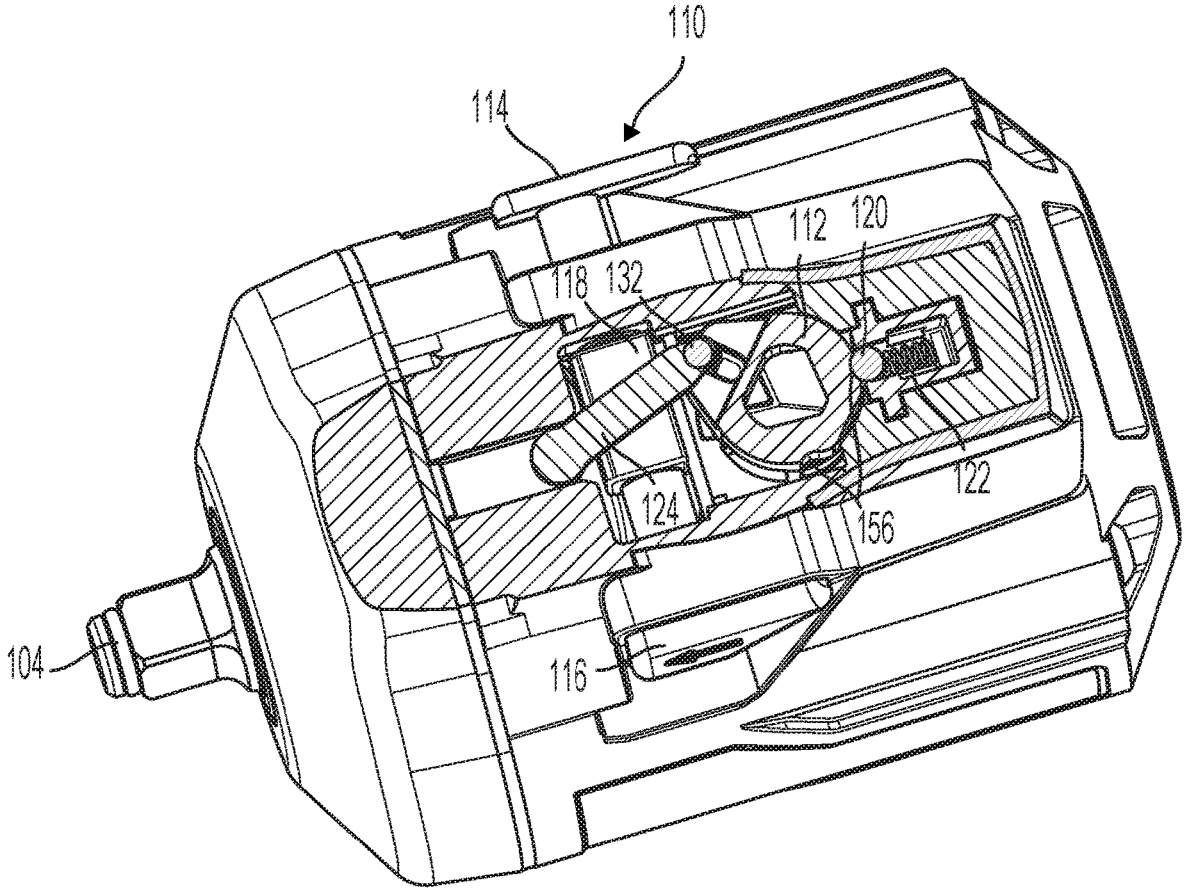
FIG. 2 is a sectional view of the tool of FIG. 1 incorporating an embodiment of the reversing mechanism of the present invention, taken along line 2-2 in FIG. 1.
Figure 3:
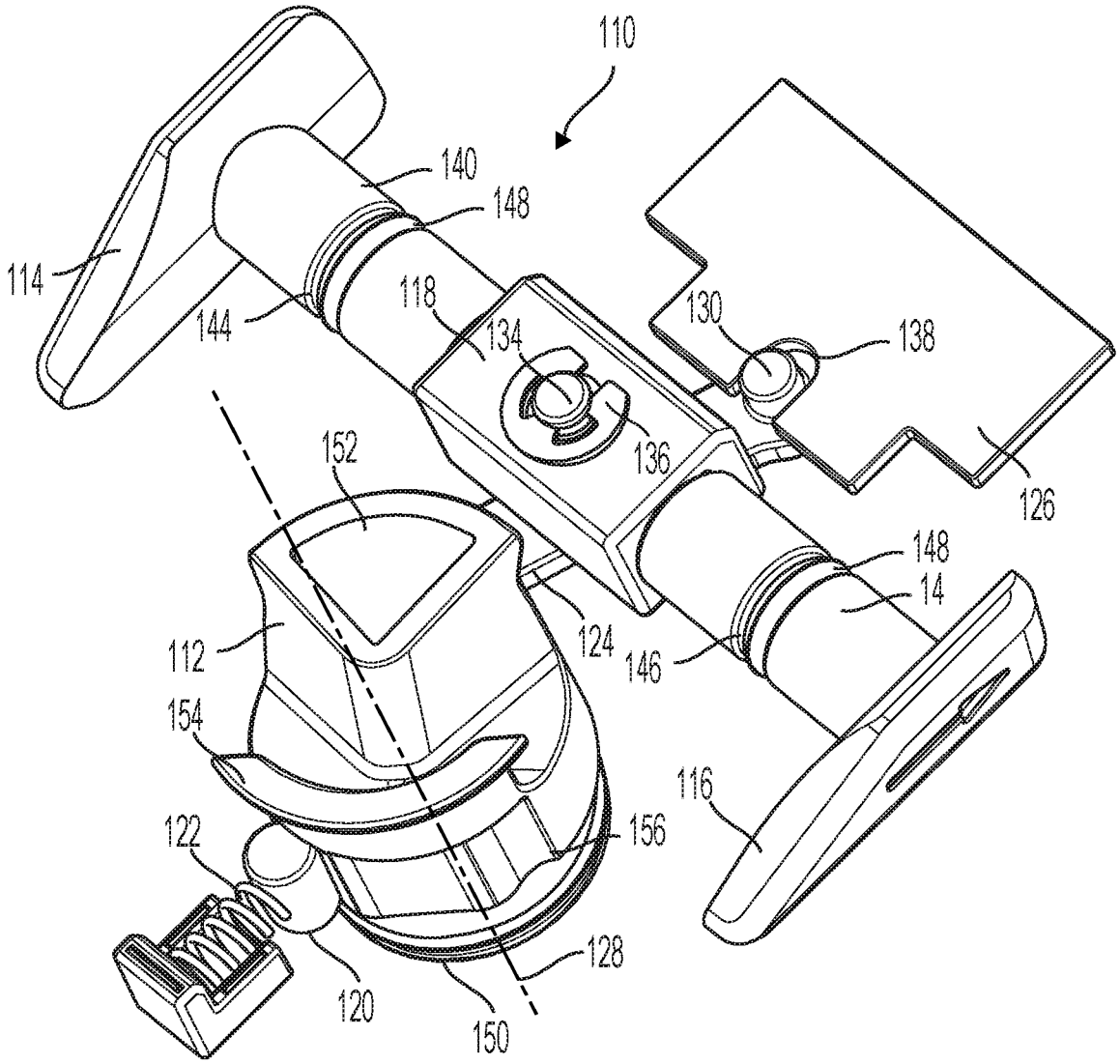
FIG. 3 is a perspective view of a reversing mechanism, according to an embodiment of the present invention.

While the present invention is susceptible of embodiments in many different forms, there is shown in the drawings, and will herein be described in detail, embodiments of the invention, including a preferred embodiment, with the understanding that the present disclosure is to be considered as an exemplification of the principles of the present invention and is not intended to limit the broad aspect of the invention to any one or more embodiments illustrated herein. As used herein, the term "present invention" is not intended to limit the scope of the claimed invention, but is instead used to discuss exemplary embodiments of the invention for explanatory purposes only.

The present invention broadly comprises a reversing mechanism for a power tool, such as, for example, a pneumatic or hydraulically powered impact wrench, with a side-to-side switch or lever mechanism for controlling a rotary face seal valve to change the rotational direction of the tool. The side-to-side switch or lever mechanism is disposed proximate to where a user operates the tool, such as a trigger. This allows for a user's index finger and thumb of the hand holding the impact wrench to actuate the side-to-side switch or lever without needing to disengage the tool from a work piece or significantly change the user's hand position to change the rotational direction of the tool.

Referring to FIGS. 1-7, a tool 100, such as, for example, a pneumatic or hydraulic impact wrench is illustrated. An impact wrench (also known as an impactor, impact gun, air wrench, air gun, rattle gun, torque gun, windy gun) delivers high torque output by storing energy in a rotating mass driven by a motor, then delivering the stored energy in impacting forces to the output shaft. As illustrated, the tool 100 includes a housing 102 containing a motor/rotor, an output lug 104, and a trigger 106 disposed adjacent to a handle 108. The trigger 106 can be actuated by a user to cause a fluid, such as, for example, pressurized air or hydraulic fluid, received at an air inlet 109 of the handle 108 from an external supply to drive the rotor of the tool 100 selectively in either one of first and second directions (e.g., clockwise and counterclockwise), thereby driving the output lug 104 in either one of first and second directions. The output lug 104, can be coupled to other devices, such as a socket or other adapter, to apply torque to a work piece, such as, for example, a screw or bolt, in the selected direction in a well-known manner.

In an embodiment, the handle 108 extends substantially perpendicular to the housing 102, and the trigger 106 is disposed proximal to an intersection of the handle 108 and housing 102. The trigger 106 can be biased such that the user can depress the trigger 106 inwardly, relative to the tool 100, to cause the tool 100 to operate, and release the trigger 106, wherein the biased nature of the trigger 106 causes the trigger 106 to move outwardly, relative to the tool 100, to cease operation of the tool 100.

The rotational direction of the rotor, and, consequently, the output lug 104, are controlled by a reversing mechanism 110 adapted to cause direction of externally supplied fluid (at the air inlet 109) in either one of first and second directions. The reversing mechanism 110 includes a valve 112, first and second buttons 114, 116, a base 118, a detent structure 120, a biasing member 122, a link arm 124, and a plate 126. A user can actuate either of the first or second buttons 114, 116 respectively disposed on opposing first and second sides of the tool 100. For example, depressing the first button 114 can cause the output lug 104 to rotate in a first or clockwise rotational direction, and depressing the second button 116 can cause the output lug 104 to rotate in a second or counterclockwise rotational direction. In some embodiments, the first and second buttons 114, 116 are disposed near the trigger 106 within easy reach of a user's fingers during operation of the tool 100, so the user can change the rotational direction of the output lug 104 by depressing either of the first and second buttons 114, 116 without disengaging the tool 100 from a work piece.

The first and second buttons 114, 116 are each coupled to or integrally formed with the base 118, so that only one of the first and second buttons 114, 116 can be depressed at a time. For example, the first and second buttons 114, 116 respectively include first and second arms 140, 142 extending through openings in the housing 102 and into the base 118. The first and second arms 140, 142 are coupled to the base 118 using adhesive, retention members, such as, for example, washers, spring washers, retaining rings, spring clips, cotter pins, or any other known device or structure that can couple the arms 140, 142 with the base 118.

In an embodiment, the first and second arms 140, 142 respectively include first and second grooves 144, 146. The first and second grooves 144, 146 are adapted to receive seals 148, such as, for example, O-rings. The seals 148 are adapted to minimize or control fluid leaking from the openings in the housing 102 and further restrict contaminates, such as, for example, dust, from entering the housing 102 from the environment that the tool 100 is being operated in.

Depressing the first button 114 inwardly relative to the tool 100 causes the second button 116 to move outwardly relative to the tool 100, and the base 118 to move linearly in a first direction. Likewise, depressing the second button 116 inwardly relative to the tool 100 causes the first button 114 to move outwardly relative to the tool 100, and the base 118 to move linearly in a second direction, opposite the first direction.

The base 118 is operably coupled to the valve 112 via the link arm 124 such that linear movement of the base 118 in either of the first and second directions causes the valve 112 to rotate about a valve axis 128 in either of first or second rotational directions to selectively distribute fluid, such as, for example, hydraulic fluid or air, received at air inlet 109 to cause the rotor disposed within the housing 102 to rotate in either of clockwise or counterclockwise directions. Accordingly, linear movement of the buttons 114, 116 causes linear movement of the base 118 and, by extension, rotational movement of the valve 112.

The link arm 124 includes first, second, and third pins 130, 132, 134 protruding therefrom. The first 130 and second 132 pins are disposed proximate to the first and second ends of the link arm 124, respectively. The third pin 134 is disposed proximate a middle area of the link arm 124.

The base 118 is rotatably coupled to the link arm 124 via the third pin 134. For example, the third pin 134 extends through an aperture in the base 118 and is adapted to engage a retention member 136 at an end of the third pin 134 that is opposite the link arm 124.

The retention member 136 can be any structure or device that restricts the third pin 134 from unintentionally disengaging from the base 118. For example, the retention member 136 can be a washer, spring washer, C-clip, retaining ring, spring clip, cotter pin, or any other suitable device or structure that can retain the third pin 134 in the aperture of the base 118.

The plate 126 includes a slot 138 adapted to receive the first pin 130 to rotatably and slidably coupled the link arm 124 to the plate 126. The plate 126 is disposed in the housing 102 towards the front of the tool 100, and is coupled to the tool 100.

The valve 112 is adapted to direct externally supplied fluid, such as, for example, air or hydraulic fluid, received at the air inlet 109 to cause the rotor of the tool 100 to rotate in either of the clockwise and counterclockwise directions, thereby also causing the output lug 104 to rotate in either of the clockwise and counterclockwise directions. Specifically, fluid is received at the inlet 109, and travels through an internal channel in the handle 108. The fluid passes through a valve inlet 150 in a body of the valve 112 and exits via a valve outlet 152 in the body of the valve 112. The valve 112 includes internal geometry adapted to direct the fluid radially outward from the center of the valve 112 as the fluid flows from the valve inlet 150 to the valve outlet 152. For example, fluid passes through a substantially circular flowpath, which is coaxial with the valve axis 128, at the valve inlet 109. The flowpath travels approximately halfway up the valve 112 were it intersects a substantially triangular flowpath that is at an angle of approximately 30° to the valve axis 128. The triangular flowpath moves the fluid radially outward relative to the valve axis 128. The triangular flowpath includes adjacent legs that are approximately 90° relative to one another and a third leg that is substantially circular with a center that is coaxial with the valve axis.

Figure 5:
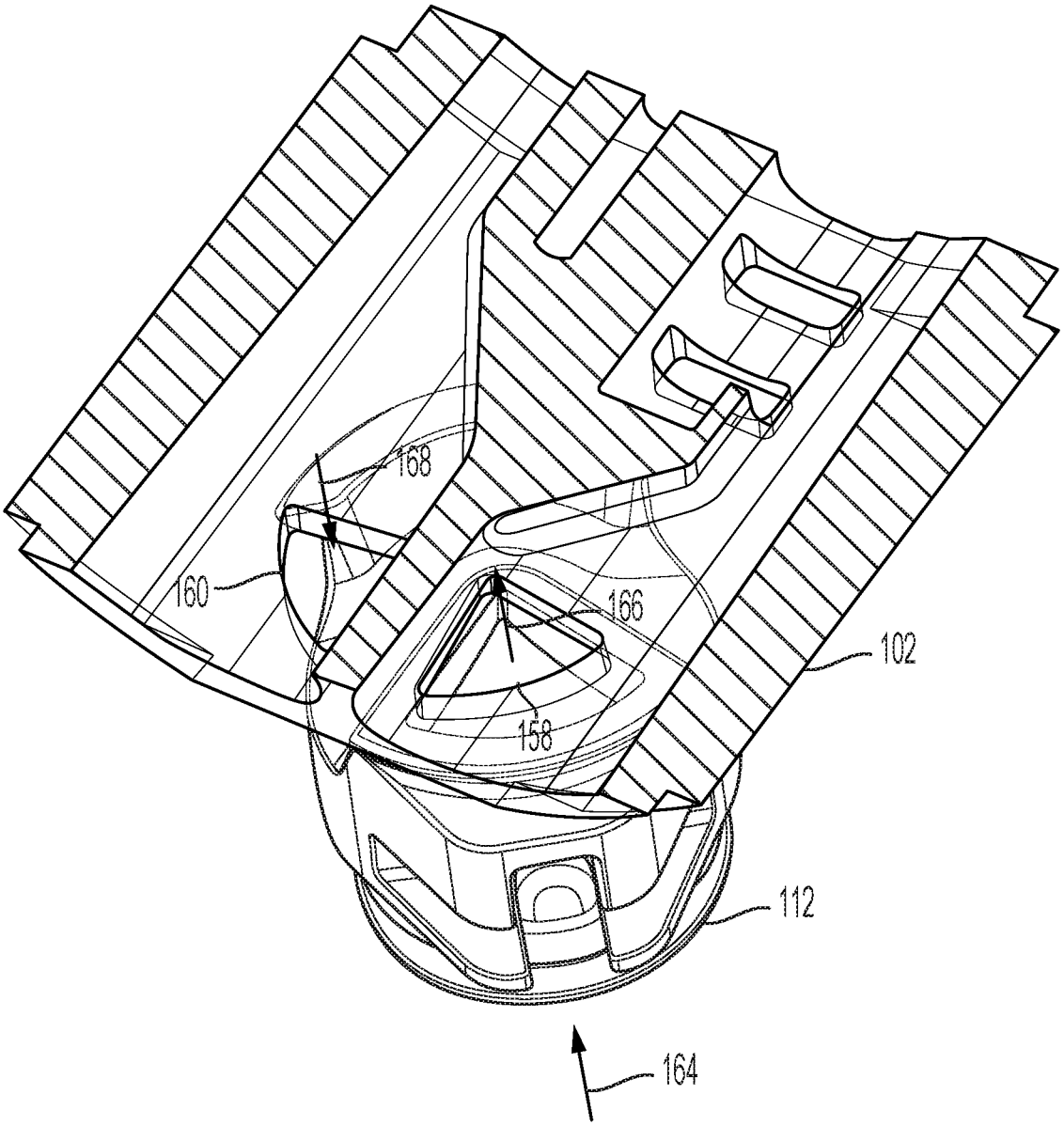
FIG. 5 is a perspective view showing an interaction of an exemplar rotary valve and a portion of a housing of a tool according to an embodiment of the present invention.
Figure 6:
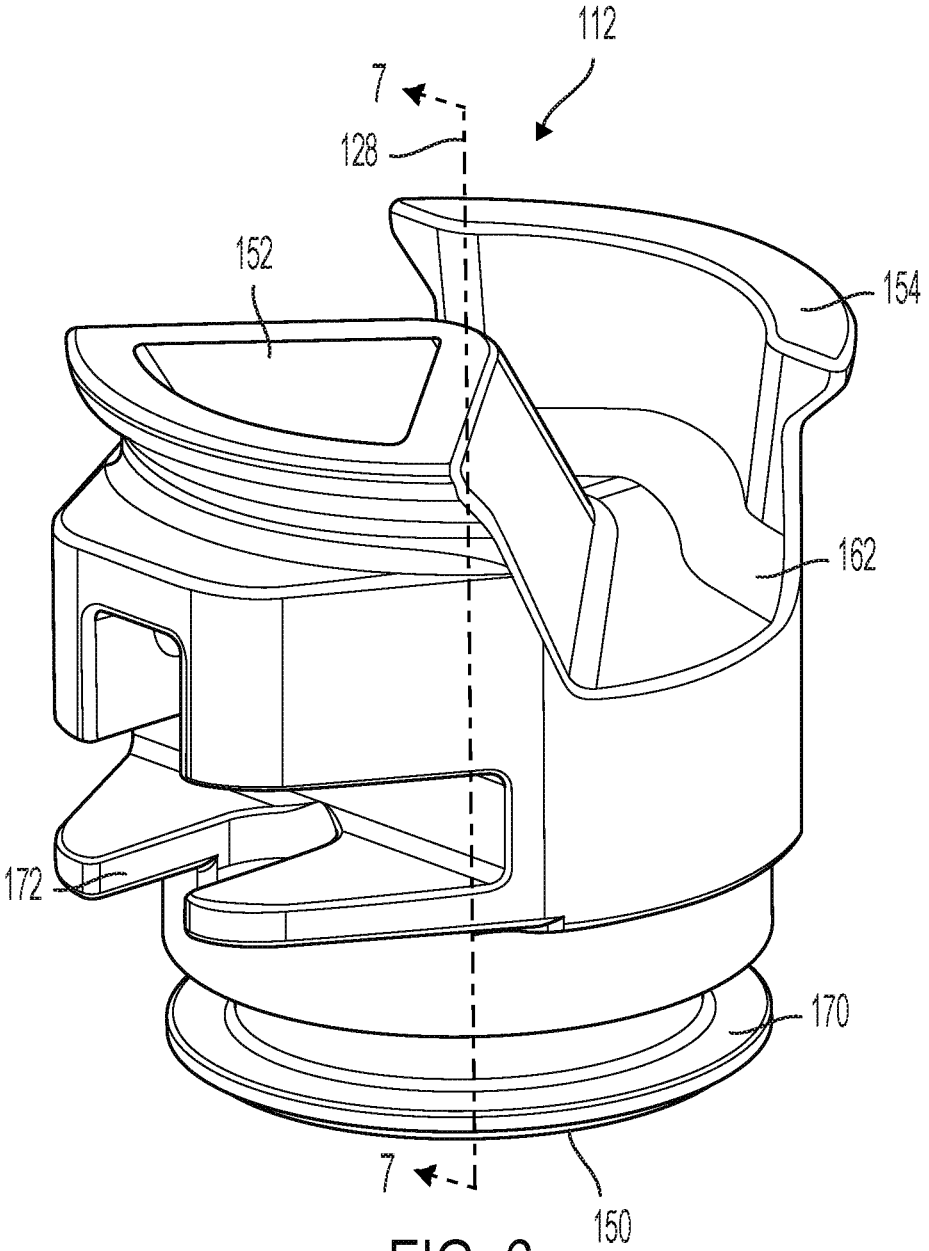
FIG. 6 is a perspective view showing an exemplar rotary valve according to an embodiment of the present invention.
Figure 7:
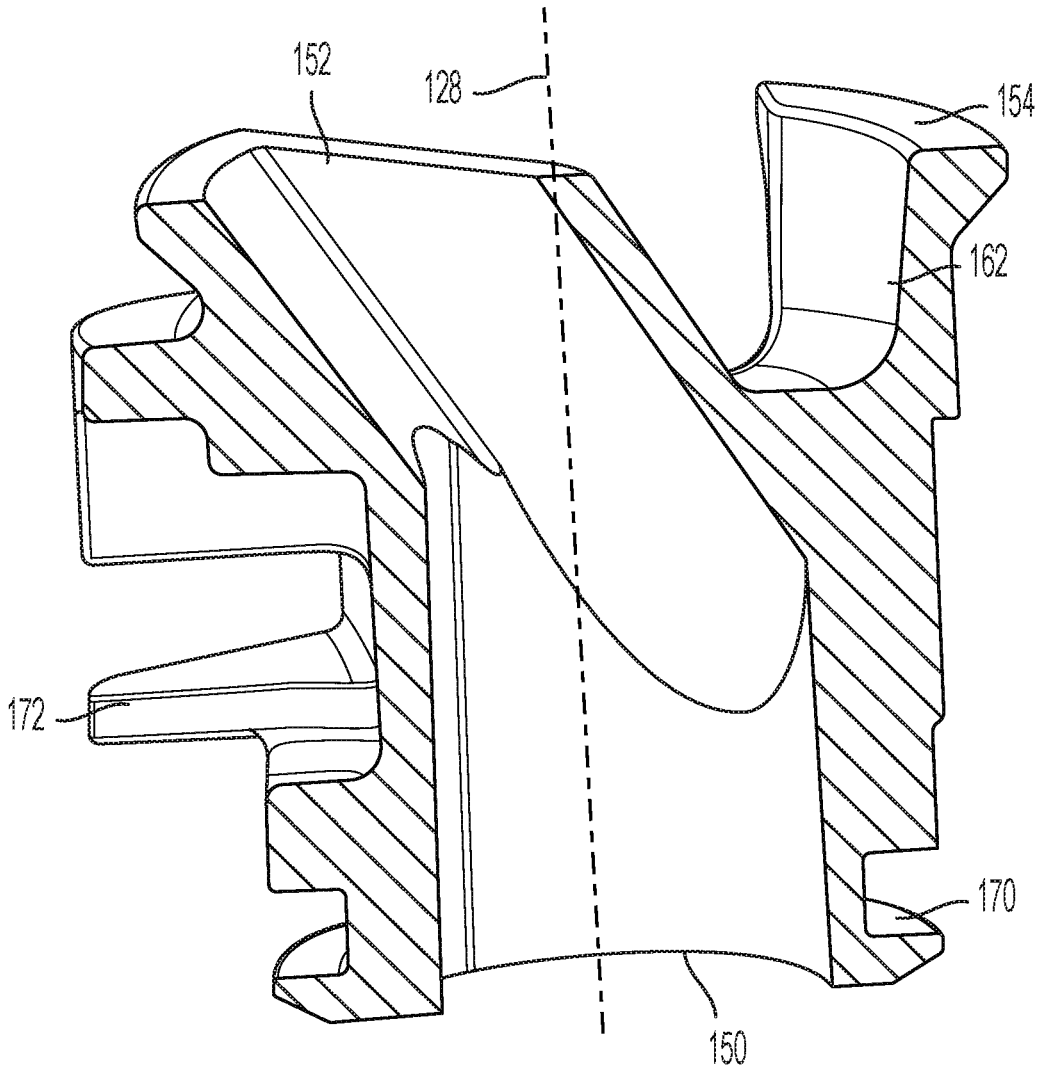
FIG. 7 is a sectional view of the rotary valve of FIG. 6, taken along line 7-7 in FIG. 6.

The valve outlet 152 is adapted to be selectively disposed in either one of first and second positions by rotation of the valve 112 about the valve axis 128. When the valve outlet 152 is disposed in the first position, as best illustrated in FIG. 5, the valve outlet 152 is aligned with a first housing opening 158 that directs fluid to drive the rotor in either of clockwise or counterclockwise directions. When the valve outlet 152 is disposed in the second position, the valve outlet 152 is aligned with a second housing opening 160 that directs fluid to drive the rotor in the other of the clockwise or counterclockwise directions. In an embodiment, the valve outlet 152 is triangularly shaped and aligns with similarly triangularly shaped first 158 and second 160 housing openings. In this example, an angle of the triangularly shaped valve outlet 152 is greater than an angle of the triangularly shaped first 158 and second 160 housing openings such that the valve outlet 152 is larger than the first 158 and second 160 housing openings, thereby allowing the first 158 and second 160 housing openings to be fully covered by the valve outlet 152 when the valve outlet is disposed in the corresponding first and second positions. For example, the angle of the valve outlet 152 is about 90° and the angle of the first 158 and second 160 housing openings is about 75°.

The valve 112 is slidably and rotatably coupled to the link arm 124 via the second pin 132. In an embodiment, the valve includes a slot 172 adapted to slidably and rotatably couple to the second pin 132. Accordingly, the link arm 124 causes rotational movement of the valve 112 about the valve axis 128 to cause the valve outlet 152 to be in either of the first and second positions in response to linear movement of the buttons 114, 116 and, by extension, the base 118. In an embodiment, the valve 112 includes a projection 154 adapted to abut an internal surface of the housing 102, thereby acting as a stabilizing member to retain the valve 112 flush to the internal surface of the housing 102. In other words, the projection 154 assists in restricting the valve 112 from tipping within the housing 102 and provides a seal between the valve 112 and the internal surface of the housing 102.

A channel 162 is formed between the projection 154 and the valve outlet 152. When the valve outlet 152 is aligned with the first housing opening 158, the valve 112 is adapted to direct fluid received by the valve inlet 150, illustrated by arrow 164 in FIG. 5, into the first housing opening 158, illustrated by arrow 166 in FIG. 5. Fluid is exhausted out of the second housing opening 160 after driving the rotor of the tool 100, illustrated by arrow 168. The exhausted fluid is directed away from rotating components of the tool 100, such as, for example, the rotor and/or the rotating connection between valve 112 and the housing 102, by the channel 162. Redirecting exhaust air away from rotating components prevents binding of the components in the event that the fluid is contaminated with particulate.

In an embodiment, the valve 112 further includes a groove 170 disposed around the outer diameter of the valve 112. The groove 170 is adapted to receive a seal, such as, for example, an O-ring, to seal the valve 112 against an inner surface of an opening in the housing 102 where the valve 112 is disposed. The seal is adapted to form a seal between the inner surface of the opening in the housing 102 and a side of the groove 170 when pressure from the fluid is present. This allows the valve 112 to freely rotate and minimizes rotational resistance while restricting fluid from leaking around the valve 112. In an embodiment, the second pin 132 allows axial movement of the valve 112 such that when pressure from the fluid is present, the valve 112 can move in an axial direction towards the housing 102 to restrict fluid leaking between the housing 102 and the valve 112. Accordingly, a valve 112 is provided herein that minimizes or restricts fluid leaks, self-energizes the sealing operation between the valve 112 and the housing 102, and minimizes rotational resistance when rotating the valve 112 between the first and second positions.

In an embodiment, the valve 112 is a rotary face seal valve. This type of valve does not require close tolerances to be maintained. Therefore, contaminants present in the externally supplied fluid can pass through the valve 112 without causing fouling issues, such as is common with conventional systems. The valve 112 can be made of corrosion resistant material, such as, for example, plastic, which also has improved sealing capability over metal. The corrosion resistant material can be used for other components of the reversing mechanism as well, such as, for example, one or more of the first and second buttons 114, 116, the base 118, the link arm 124, and the plate 126.

The reversing mechanism 110 further includes a detent structure, such as a ball or pin 120. The detent structure 120 is biased outwardly by the biasing member 122, such as, for example, a coil spring, a leaf spring, torsion or double torsion spring, tension spring, compression spring, tapered spring, or simply an object elastically biased against the detent structure 120. Further, the biasing member 122 need not be a spring, or even an elastically biased device, and can be any device that applies an electrical, magnetic, mechanical, or any other type of force to the detent structure 120. Any other implementation of the biasing member 122 can be carried out without departing from the spirit and scope of the present invention. The valve 112 has corresponding detent engagements 156 adapted to respectively receive the detent structure 120.

The detent structure 120 and the corresponding detent engagements 156 provide a tactile response to a user when the user has successfully selected the rotational direction of the output lug 104. For example, when the user selectively depresses one of the first or second buttons 114, 116, the base 118 moves linearly in a direction substantially perpendicular to the valve axis 128 of the valve 112, and the valve 112 rotates about the valve axis 128. In doing so, the detent structure 120 creates a snap-action when it engages one of the detents 156 of the valve 112, thereby providing tactile feedback to the user that the selected rotational direction of the output lug 104 is in place. In other words, when the detent structure 120 cooperatively engages one of the detent engagements 156 of the valve 112, the valve outlet 152 is in the necessary position to direct fluid to cause the selected rotational direction. Similarly, when the other of the first or second buttons 114, 116 is selectively depressed by the user, the base 118 moves linearly in an opposite direction substantially perpendicular to the valve axis 128 of the valve 112, and the valve 112 rotates about the valve axis 128 in an opposite direction. In doing so, the detent structure 120 creates a snap-action when it cooperatively engages another of the detent engagements 156 of the valve 112, thereby selecting the second rotational direction of the output lug 104. In an embodiment, the valve 112 requires about 85° of rotation in either of first or second rotational directions about the valve axis 128 to selectively distribute fluid, such as, for example, hydraulic fluid or air, received at air inlet 109 to cause the rotor disposed within the housing 102 to rotate in either of clockwise or counterclockwise directions.

Figure 4:
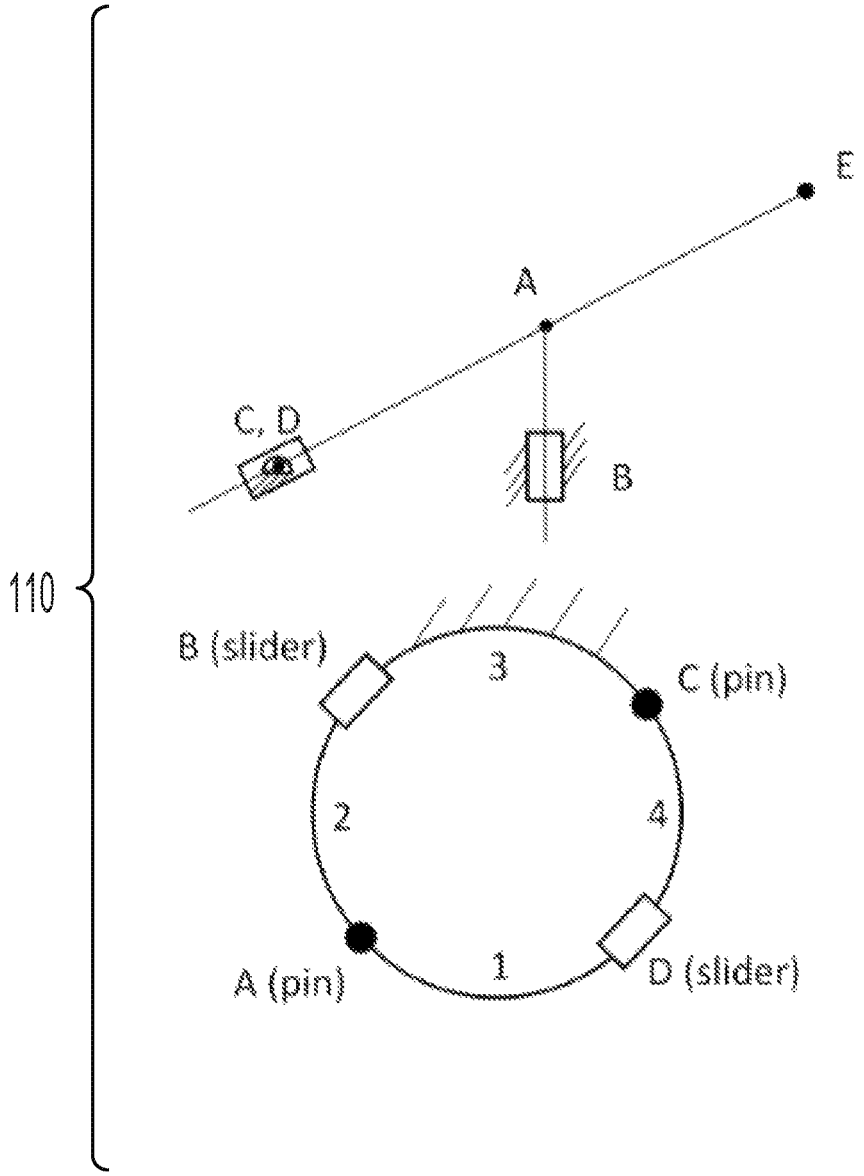
FIG. 4 is a schematic showing interaction of components of a reversing mechanism according to an embodiment of the present invention.

Accordingly, side-to-side buttons 114, 116 are coupled to the valve 112 using a four-bar linkage. The four-bar linkage is shown in FIG. 4 and is configured such that the end of the link arm 124 that effects the valve 112 (point E) has greater lateral movement than the input linear motion at the buttons 114, 116 (slider joint B). The slider joint B permits the linear motion of the base 118 via depression of the buttons 114, 116. Since link 2 is not able to rotate at B, the slider joint D is made coincident with the pin joint C to prevent lockup. The resulting benefit of the four-bar linkage is that lateral motion at point E (the connection point of the link arm 124 and the valve 112) will be greater than the input motion at slider joint B. The mechanical advantage of the four-bar linkage is less than 1. In other words, lateral force applied at slider joint B (via buttons 114, 116) is greater than the resulting lateral force at point E (the connection point of the link arm 124 and the valve 112).

As discussed herein, the tool 100 can be a pneumatic or hydraulically operated tool, such as, for example, an impact wrench. However, the tool 100 can be any pneumatically or hydraulically powered or hand-held tool, including, without limitation, a ratchet wrench, torque wrench, impact wrench, drill, saw, hammer, or any other tool.

As discussed herein, the term "fluid" includes, but is not limited to, air and hydraulic fluid.

As used herein, the term "coupled" or "communicably coupled" can mean any physical, electrical, magnetic, or other connection, either direct or indirect, between two parties. The term "coupled" is not limited to a fixed direct coupling between two entities.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A tool having opposing first and second sides and powered by a fluid including a motor having a rotor that rotates in either of first and second rotational directions, the tool comprising:

first and second buttons respectively disposed on the first and second sides;

a base disposed between and operatively coupled to the first and second buttons;

a valve having a valve axis and that is adapted to selectively direct the fluid to cause the rotor to rotate in either one of the first and second rotational directions; and a link arm rotatably coupled to the base and slidably and rotatably coupled to the valve, wherein linear movement of the base causes the link arm to rotate the valve about the valve axis.

2. The tool of claim 1, wherein the first and second buttons are disposed adjacent to a trigger disposed in the tool that is adapted to cause operation of the tool, and wherein the buttons are slidably coupled to the tool.

3. The tool of claim 1, wherein the fluid is air.

4. The tool of claim 1, wherein the fluid is pressurized hydraulic fluid.

5. The tool of claim 1, wherein the link arm includes first, second, and third pins, the first and second pins are respectively disposed proximate to first and second ends of the link arm, and the third pin is disposed in a middle area of the link arm.

6. The tool of claim 5, wherein the first pin is slidably and rotatably coupled to a slot in a plate disposed in the tool, the second pin is slidably and rotatably coupled to the valve, and the third pin is rotatably coupled to the base.

7. The tool of claim 6, wherein the third pin is adapted to receive a retention member.

8. The tool of claim 1, wherein the valve is a rotary face seal valve.

9. The tool of claim 1, further comprising a detent structure elastically biased towards the valve, wherein the valve includes detent engagements adapted cooperatively engage the detent structure to provide a tactile indication when either one of the first and second rotational directions is selected.

10. The tool of claim 1, wherein movement of the base is substantially perpendicular to the valve axis.

11. A reversing mechanism for a tool powered by a fluid and having a rotor operable to drive an output lug in either one of first and second rotational directions, the mechanism comprising:

a base coupled to first and second buttons;

a valve having a valve axis and adapted to selectively direct the fluid to cause the rotor to drive the output lug in either one of the first and second rotational directions; and a link arm rotatably coupled to the base and slidably and rotatably coupled to the valve, wherein movement of the base causes the link arm to rotate the valve about the valve axis.

12. The reversing mechanism of claim 11, wherein the first and second buttons are disposed adjacent to a trigger of the tool that is adapted to cause operation of the tool.

13. The reversing mechanism of claim 11, wherein the fluid is pressurized hydraulic fluid.

14. The reversing mechanism of claim 11, wherein the fluid is air.

15. The reversing mechanism of claim 11, wherein the link arm includes first, second, and third pins, wherein the first and second pins are respectively disposed proximate to first and second ends of the link arm, and the third pin is disposed in a middle area of the link arm.

16. The reversing mechanism of claim 15, wherein the first pin is slidably and rotatably coupled to a slot in a plate disposed in the tool, the second pin is slidably and rotatably coupled to the valve, and the third pin is rotatably coupled to the base.

17. The reversing mechanism of claim 16, wherein the third pin is adapted to receive a retention member.

18. The reversing mechanism of claim 11, wherein the valve is a rotary face seal valve.

19. The reversing mechanism of claim 11, further comprising a detent structure biased towards the valve, wherein the valve includes detents adapted receive the detent structure to provide a tactile indication when either of the first and second rotational directions is selected.

20. The reversing mechanism of claim 11, wherein movement of the base is substantially perpendicular to the valve axis.

21. The reversing mechanism of claim 11, wherein the first and second buttons are respectively disposed on first and second opposing sides of the tool.

22. The reversing mechanism of claim 11, wherein the tool is a pneumatic impact wrench.

23. A valve rotatable about a valve axis to selectively direct fluid to cause a rotor of a tool to drive an output lug of the tool in either one of first and second rotational directions, the valve comprising:

a valve inlet;

a valve outlet;

a projection adapted to abut a housing of the tool;

a channel disposed between the projection and the valve outlet and adapted to direct fluid away from a valve to housing rotary connection; and a slot adapted to be slidably and rotatably coupled to a link arm, wherein the link arm is adapted to cause rotational movement of the valve about the valve axis in response to linear movement of first and second buttons of a reversing mechanism, the first and second buttons respectively disposed on first and second sides of the tool.

24. The valve of claim 23, wherein internal geometry of the valve is adapted to direct the fluid radially outwards from a center of the valve as the fluid flows from the valve inlet to the valve outlet.

25. The valve of claim 23, wherein the valve is adapted to be selectively rotated to first and second positions, wherein when the valve is in the first position, the valve outlet is aligned with a first housing opening, and wherein when the valve is in the second position, the valve outlet is aligned with a second housing opening.

26. The valve of claim 25, wherein the valve outlet and the first and second housing openings have a triangular shape.

27. The valve of claim 25, wherein the valve outlet is larger than either of the first and second housing openings.

28. The valve of claim 23 further comprising a groove disposed around an outer diameter of the valve, the groove adapted to receive a seal.

29. The valve of claim 23, wherein the valve is a rotary face seal valve.

30. The valve of claim 23, wherein the valve includes detents adapted receive a detent structure to provide a tactile indication when either of the first and second rotational directions is selected.

31. The valve of claim 23, wherein the valve requires about 85° of rotation in either one of first and second rotational directions about the valve axis to selectively direct the fluid to cause the rotor to drive the output lug in either one of the first and second rotational directions.

* * * * *